US010927555B2

(12) United States Patent
Collier

(10) Patent No.: US 10,927,555 B2
(45) Date of Patent: Feb. 23, 2021

(54) METHOD FOR IMPROVING THE VENTILATION EFFECTIVENESS OF LARGE CONDITIONED AIR PLENUM ENVIRONMENTS INCLUDING SUCH ENVIRONMENTS IN MULTILEVEL RAISED FLOOR ELECTRO-MECHANICAL DISTRIBUTION SYSTEMS

(71) Applicant: William Randolph Collier, Esterel (CA)

(72) Inventor: William Randolph Collier, Esterel (CA)

(73) Assignee: INTERSTITIAL SYSTEMS INC., Esterel (CA)

( * ) Notice: Subject to any disclaimer, the term of this patent is extended or adjusted under 35 U.S.C. 154(b) by 241 days.

(21) Appl. No.: 15/932,918

(22) Filed: May 21, 2018

(65) Prior Publication Data

US 2018/0334811 A1 Nov. 22, 2018

Related U.S. Application Data

(60) Provisional application No. 62/603,174, filed on May 20, 2017.

(51) Int. Cl.

| | |
|---|---|
| ***E04F 15/02*** | (2006.01) |
| ***F24F 7/00*** | (2006.01) |
| ***E04F 17/04*** | (2006.01) |
| ***E04F 15/024*** | (2006.01) |

(52) U.S. Cl.

CPC ..... *E04F 15/02464* (2013.01); *E04F 15/024* (2013.01); *E04F 17/04* (2013.01); *F24F 7/00* (2013.01)

(58) Field of Classification Search

CPC ..... E04F 15/02464; F24F 7/00; F24F 17/04; F24F 15/024

USPC ..... 52/220.2

See application file for complete search history.

(56) References Cited

U.S. PATENT DOCUMENTS

| | | | | | |
|---|---|---|---|---|---|
| 3,420,018 | A * | 1/1969 | Fork | E04B 5/48 | 52/220.5 |
| 3,516,347 | A * | 6/1970 | May | F24F 12/001 | 454/185 |
| 3,592,956 | A * | 7/1971 | Fork | H02G 3/283 | 174/481 |
| RE28,035 | E * | 6/1974 | Fork | H02G 3/283 | 174/486 |
| 4,417,191 | A * | 11/1983 | Schmidt | H02P 3/24 | 318/760 |
| 4,852,315 | A * | 8/1989 | Fukayama | H02G 3/285 | 52/220.3 |

(Continued)

*Primary Examiner* — Jeanette E Chapman

(74) *Attorney, Agent, or Firm* — Norton Rose Fulbright Canada LLP

(57) ABSTRACT

The present invention is intended for use in large conditioned air plenum environments and particularly in the plenum environment of multilevel raised floor electro-mechanical distribution systems. The invention comprises the step of providing at least one height change of dedicated conditioned air plenum, which alters the plenum's volume. This makes it possible to maintain the preferred static pressure and velocity for conditioned air throughout the entire plenum even as the amount of air in the plenum decreases as conditioned air discharges into the intended space outside of the plenum.

20 Claims, 5 Drawing Sheets

(56) References Cited

U.S. PATENT DOCUMENTS

| | | | | | |
|---|---|---|---|---|---|
| 4,874,127 | A * | 10/1989 | Collier | F24F 3/044 | 236/49.5 |
| 4,887,663 | A * | 12/1989 | Auxier | F23R 3/002 | 165/47 |
| 5,144,793 | A * | 9/1992 | Able | F23R 3/045 | 60/800 |
| 5,468,184 | A * | 11/1995 | Collier | F24F 7/08 | 454/186 |
| 5,483,776 | A * | 1/1996 | Poppe | H02G 3/285 | 174/486 |
| 5,546,717 | A * | 8/1996 | Penczak | H02G 3/285 | 174/482 |
| 5,901,515 | A * | 5/1999 | Chen | E04F 15/02405 | 52/220.1 |
| 6,604,993 | B1 * | 8/2003 | Boniface | E04F 15/02458 | 165/168 |
| 8,295,035 | B2 * | 10/2012 | Collier | H02G 3/385 | 361/678 |
| 2003/0097806 | A1 * | 5/2003 | Brown | E04B 5/04 | 52/220.1 |

* cited by examiner

METHOD FOR IMPROVING THE VENTILATION EFFECTIVENESS OF LARGE CONDITIONED AIR PLENUM ENVIRONMENTS INCLUDING SUCH ENVIRONMENTS IN MULTILEVEL RAISED FLOOR ELECTRO-MECHANICAL DISTRIBUTION SYSTEMS

CROSS-REFERENCE TO RELATED APPLICATIONS

I hereby claim under Title 35, United States Code, Section 119(e), the benefit of U.S. provisional patent application Ser. No. 62/603,174 filed May 19, 2017. The 62/603,174 provisional application is hereby incorporated by reference into this application.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPONENT DISK APPENDIX

Not Applicable

BACKGROUND OF THE INVENTION

1. Field of the Invention

The present invention is directed to a method for enhancing the air distribution and air delivery effectiveness, aka, "ventilation effectiveness," of large conditioned air plenum environments and, as discussed herein, particularly of the large plenum environment included in multilevel raised floor electro-mechanical distribution systems (sometimes herein "systems" or "system"), which plenum environment is an integrated and integral element of such systems.

2. Description of the Related Art

Discussion in the specification of prior art products and designs is included to afford a better understanding of the long persisting problems addressed and solved by the subject invention. Providing this context should in no way be considered as an admission that such prior art creates any limitation on the scope of the invention or on its new and nonobvious character.

a. Conventional Raised Access Floors

In the conventional raised floor design used for decades, conditioned air and electrical conductors are routed through the volume that exists between the underside of the walking-floor panels of the raised floor and the surface of the building slab. Removing any floor panel, for example to reach the electrical services housed beneath, causes conditioned air to escape downstream from where it is needed to cool equipment, and removing more than just a few panels at once, for example to lay, reroute, or remove electrical conductors, compromises the structural integrity of the raised floor itself.

For this reason, disconnected cables are often simply abandoned in place where they pile up to block airflow and make the installation of new cables difficult and time consuming. To accommodate the underfloor congestion, a higher raised floor than would otherwise be necessary or optimum must be installed, which further decreases ventilation effectiveness and often limits room location options due to the higher ceilings required because of the higher floor. Even when all panels are in place, air that is supposed to travel to where it will cool equipment instead leaks from panel joints and cable cutouts.

Air distribution in the conventional raised floor scheme relies on the throw distance of a package air-handling unit's (AHU) fan. If ideal conditions are provided and maintained, which never happens in practical application, an AHU fan's maximum throw distance under the floor is approximately 30 feet in a pie-slice shaped pattern. This means that in order to supply some degree of area coverage for the conditioned air it is necessary to install AHUs throughout a room's white space . . . space that could otherwise be used for additional computer equipment. Hot spots and cold spots are common in such installations, requiring in-line coolers, pedestal fans, and the like, which create their own undesirable heat and take up space. It is impossible to provide N+1 redundancy in such designs because redundancy actually requires that every AHU have another AHU installed right next to it.

Under the conditions encountered in actual computer room environments, effective redundancy is an illusion anyway because of all the impediments to air distribution described above. In recent years, out of desperation to provide enough air where it is needed, designs using conventional floors have begun to incorporate extremely expensive and inflexible hot aisle/cold aisle "containment" schemes, which are extremely expensive and severely restrict the flexibility of the rooms into which they are installed.

b) "Flooded Room" Air Delivery Designs

Room designs that eschew raised floors altogether in favor of placing equipment directly on the building slab have become more common, but do not fare much better than the conventional raised floor approach. In these designs the room containing equipment needing cooling is flooded with conditioned air. Hot aisle containment schemes are installed at great expense both in terms of money and of ongoing room flexibility. In many instances wires and cables are strung overhead in ladder trays, which is also very costly. Both supply air and return air flow are negatively affected by the electrical conductors descending from the ceiling to the equipment.

In a variation of this design, a conventional raised access floor is used to house and route electrical conductors underneath the walking surface, which adds additional expense and logistical challenges. Although these options may avoid some of the difficulties associated with the conventional raised floor scheme, they are plagued by its own host of problems and limitations.

c) Multi-Level Raised Floor Electro-Mechanical Distribution Systems

The inventor of the present invention is also the inventor of the multilevel raised floor electro-mechanical distribution system in association with which the present invention is intended to be used. These systems are the subject of the inventor's U.S. Pat. Re 33220 as well as the more recent U.S. Pat. No. 8,295,035.

For the most part, multilevel raised floor electro-mechanical distribution systems serve data centers and similar rooms having significant heat loads, substantial cooling requirements, and extensive runs of cables and power wiring. In these environments, the multilevel electro-mechanical distribution system provides myriad benefits, including remarkable ventilation effectiveness, which can be even further improved by the subject invention.

The inventor's '035 patent recounts the facts that data center heat loads have greatly increased over the decades, while at the same time the cost of electricity used for cooling has skyrocketed and the increasing demand for electricity has actually outstripped supply in many regions. Adequate cooling in the data center environment is vital, however, and cannot be compromised because overheated computer and auxiliary equipment can result in system-wide failure, permanent data losses, extensive hardware damage, and even fires.

The ventilation effectiveness provided by the multilevel electro-mechanical distribution system eliminates the air distribution headaches that plague data centers using conventional raised floors and other designs that rely on expensive and inflexible containment. It also solves all the wire distribution problems of the conventional floor and on-slab "flooded room" configurations.

The system comprises at least two dedicated levels under its walking and computer equipment support surface, which surface is typically supplied by modular raised access floor panels such as those used with conventional raised floors. In a two-level system, the division into the respective upper and lower levels is created by a horizontally extending plane that is substantially coextensive in area with the walking and equipment support surface above it and vertically spaced apart from it.

This horizontal plane intermediate between the upper surface of the building floor, from which it is spaced apart vertically, and the underside of the raised floor panels, is substantially parallel with each, and has traditionally been referred to as the "conductor support floor." In the inventor's current commercial product it comprises gasketed modular metal panels or "pans" installed adjacent each other with their respective edges in compressive abutment with one another, thus providing a continuous and virtually airtight expanse. Electrical conductors, often laid directly on the conductor support floor, are housed and routed through the upper level dead air volume this configuration creates. The conductors so housed are completely separated from conditioned air.

The lower level, between the building slab surface and the underside of the conductor support floor, serves as a dedicated, obstruction-free and virtually leak-free air plenum. Conditioned air is introduced into the dedicated plenum where desired and adequate, consistent air pressure is maintained throughout it. The pressurized cool air is released from the plenum and into the workspace to cool equipment through easy-to-move adjustable vertical air-flow passage units, or "chimneys," extending from the conditioned air plenum and through the upper level. In this way, the wire way level remains free of conditioned air flow.

Because of the significant and consistent static pressure achieved in the dedicated air plenum, it is unnecessary to scatter Air Handling Units (AHUs) throughout the room, which can save a substantial amount of valuable interior space. Instead, air conditioners can be disposed along a room's perimeter, or in a separate mechanical room, even in larger area installations.

The number of air handlers needed can often be reduced by using larger units, and true N+1 redundancy, i.e., emergency backup for the entire space, can be supplied by a single unit. The system makes it possible to match the air conditioning capacity to the actual head load of the room more accurately because, in contrast to designs using conventional floors, it is unnecessary to install AHUs merely to provide area coverage based on theoretical AHU fan throw distance. This can lead to remarkable energy savings. Also, unlike conventional installations, the air conditioners used with the multilevel system do not have to be relocated when computer equipment is moved or added.

BRIEF SUMMARY OF THE INVENTION

The present invention is intended for use in large conditioned air plenum environments and as described and discussed herein, particularly in the plenum environment of multilevel raised floor electro-mechanical distribution systems discussed above. The invention described and claimed herein comprises the step of providing at least one height change of the dedicated conditioned air plenum, which alters the plenum's volume. This makes it possible to maintain the preferred static pressure and velocity for conditioned air throughout the entire plenum even as the amount of air in the plenum decreases as conditioned air discharges into the intended space outside of the plenum. The invention provides this very significant benefit even at great distances from the air conditioning units serving the room. The claimed method contributes to the superior ventilation effectiveness of multilevel electro-mechanical distribution systems in even the largest installations, which can reach tens of thousands or sometimes hundreds of thousands of square feet. It can also be used to advantage in smaller area rooms, particularly where such rooms have high heat loads for which large volumes of conditioned air are required.

Where a change or changes in plenum height is/are provided is determined by mechanical engineering calculations that take into consideration a room's heat load, the area of the room, supply air volume, and other pertinent data.

There has been outlined the important features of the present inventive method in order that the detailed description of it can be better understood, and in order that the present contribution to the art may be better appreciated. Before explaining one or more embodiment of the invention in greater detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for purposes of the description and should not be regarded as limiting.

A primary objective of the present invention is to provide a method for improving the ventilation effectiveness of the dedicated, isolated conditioned air plenum of multilevel raised floor electro-mechanical distribution systems.

A second object is to provide a method that is simple to accomplish and can be undertaken at the time such systems are installed.

Another object of the invention is to provide a method that requires the use of relatively inexpensive and simple to fabricate parts, which can be modular, to provide a plenum transition barrier that confines air to a conditioned air plenum where said plenum transitions from a higher to a lower plenum portion.

An additional object of the invention is to provide a method for improving the ventilation effectiveness of large plenum environments such as in plenum ceilings and raised floor plenum applications.

BRIEF DESCRIPTION OF THE DRAWINGS

Various other objects, features, and attendant advantages of the present invention will become fully appreciated as it becomes better understood when considered in the light of the accompanying drawings, in which like characters designate the same or similar parts in each, and wherein.

DETAILED DESCRIPTION OF THE INVENTION

While it will be understood that the concept of the invention is applicable to a number of installations, and that constructional details of it may be varied, a description of the preferred form of the inventive method will be given.

Figure 1:
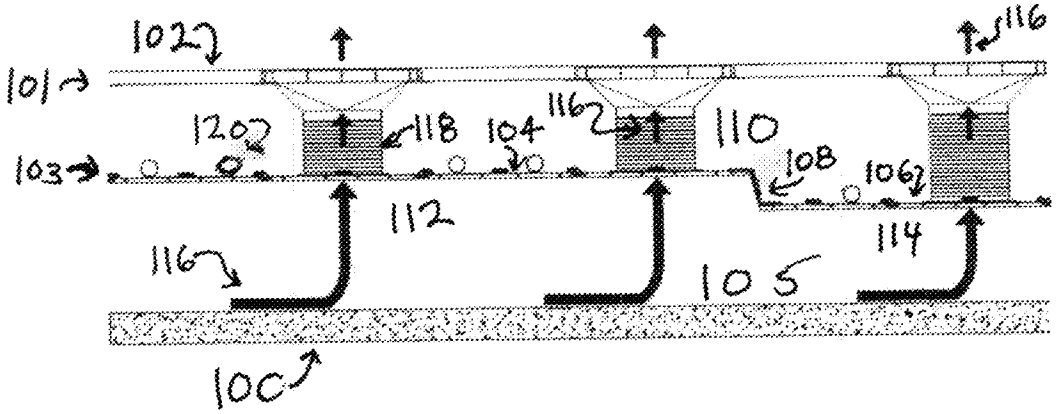
FIG. 1 is a side view, in part diagrammatic in character, of the present invention being utilized in a two-level multilevel raised floor electro-mechanical distribution system. Portions of the system have been cut-away and certain parts removed for illustrative purposes, such as the closure extending around the outer perimeter of the wire way level of the system, and the vertical members supporting the system. Depictions and descriptions of those structures can be found in the inventor's '035 patent mentioned above. The drawing depicts application of the invention in an air plenum configuration having two heights, which differing heights are created by the respective vertical distances from the building floor of a greater height section and a lesser height section of the conductor support floor.

Referring now to the drawings in greater detail, there is shown in FIG. 1 a portion of a two-level multilevel raised floor electro-mechanical distribution system generally designated 101 installed on building slab 100. Below the system's walking surface 102 and vertically spaced apart from it is the system's conductor support floor, generally designated 103. In FIG. 1, conductor support floor 103 comprises a higher conductor support floor section 104 and a lower conductor support floor section 106, which together are substantially co-extensive in area with the walking surface. The volume between the underside of walking surface 102 and the upper surface of the conductor support floor 103 comprises the system's wire way level 110. Electrical conductors 120 are shown housed in the wire way level and lying on the conductor support floor. Beneath the conductor support floor 103 is the system's dedicated, isolated conditioned air plenum, generally designated 105. The air plenum is substantially co-extensive in area with walking surface 102 and conductor support floor 103. The air plenum has a higher portion 112 and a lower portion 114 created by the higher conductor support floor section 104 and the lower conductor support floor section 106, respectively. At the point where higher conductor support floor section 104 and lower conductor support floor section 106 meet, which is also the transition between higher plenum height portion 112 and lower plenum height portion 114, there is positioned a plenum transition barrier 108 extending substantially vertically from the edge of the higher conductor support floor section to the edge of the lower conductor support floor section to close off the vertical gap between them as shown. Plenum transition barrier 108 stops conditioned air 116 in air plenum 105 from entering the wire way level 110, and also stops electrical conductors 120 housed in the wire way level from entering the air plenum, through said vertical gap. Conditioned air 116 travels through the plenum and above walking surface 102 through air passages 118 extending vertically from conditioned air plenum 105 and through wire way level 110. Conditioned air 116 is introduced from air conditioning units, not shown, into higher plenum portion 112. As the conditioned air 116 travels through conditioned air plenum 105 some of it leaves the plenum through vertical air passages 118 and so the amount of air in the plenum decreases, losing velocity and related favorable pressure characteristics. When the remaining air reaches lower height plenum portion 114 the decrease plenum volume created by the decreased plenum height restores the desired air movement and pressure, making it possible to distribute conditioned over a far greater distance than would otherwise be possible.

Figure 2:
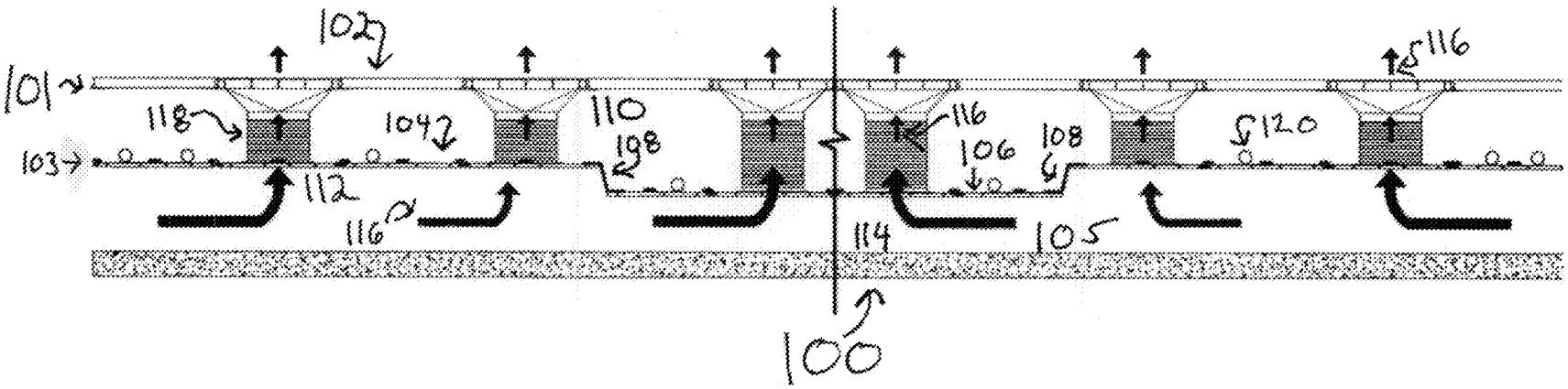
FIG. 2 is a side view similar to that of FIG. 1, but illustrating the system's air plenum having two different heights wherein the lower height plenum portion is positioned in-between two higher plenum portions. This configuration would be used primarily in a very large room where conditioned air is introduced into the system from two opposite sides of the room.

FIG. 2 illustrates a variation of the two plenum height configuration depicted in FIG. 1. Once again there is shown a two-level multilevel raised floor electro-mechanical distribution system 101 disposed on building slab 100. There is a conductor support floor 103 having a higher section 104 and a lower section 106. There is a conditioned air plenum 105 through which conditioned air 116 flows until it is discharged above walking surface 102 through vertical air passages 118 that extend upward through the system's wire way level 110. As in FIG. 1 conditioned air plenum 105 comprises a higher plenum portion 112 and a lower plenum portion 114. The difference between FIG. 1 and FIG. 2, is that in the latter drawing the lower height plenum portion 114 divides the higher plenum portions 112 in two. In other words, it is disposed between two parts of the higher plenum portion. This means that there are two places where conductor support floor 103 transitions from a higher conductor support floor section 104 to a lower conductor support floor section 106, which in turn necessitates the placement of two plenum transition barriers 108. The configuration shown in FIG. 2 would be used primarily in a very large room where conditioned air is introduced into the system from two opposite sides of the room. At each end of the room conditioned air 116 would be introduced into the respective parts of divided higher plenum portion 112 through which it would be distributed with some air leaving the plenum through vertical air passages 118. By the time conditioned air 116 reaches the approximate midpoint of the room its volume will have substantially lessoned and its static pressure become unfavorable thereby decreasing its velocity. When the remaining air "squeezes" into the smaller volume of the lower height plenum portion desired pressure and velocity will be restored, thereby improving the already remarkable ventilation effectiveness of the system.

Figure 3:
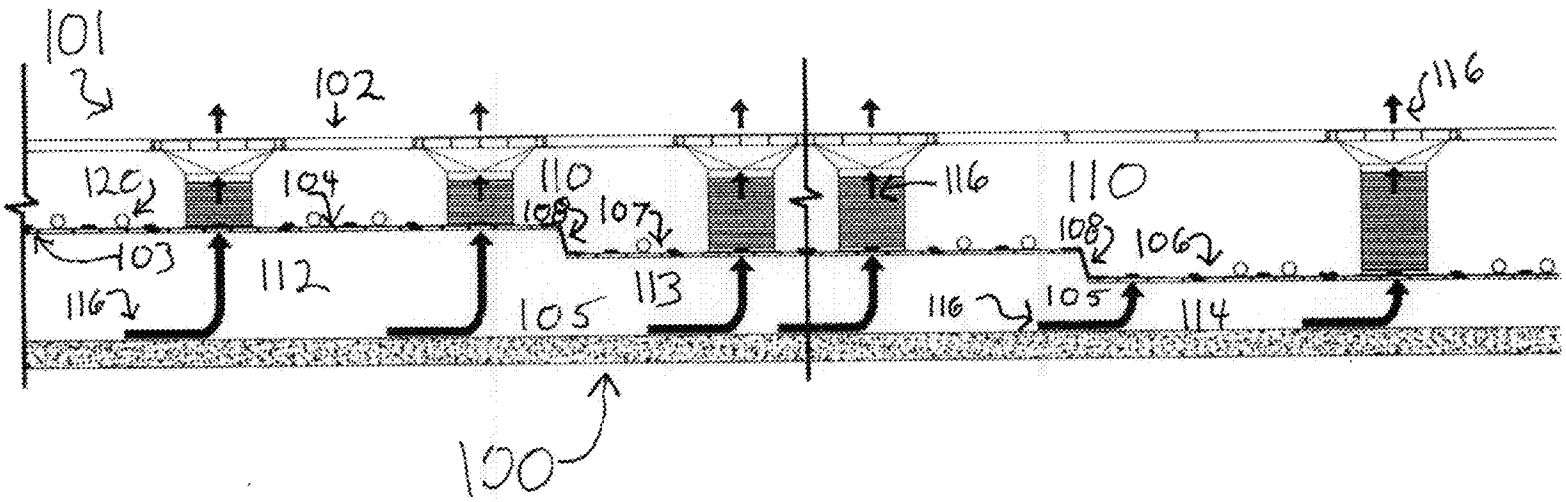
FIG. 3 presents a side view of the system similar to what is shown in FIG. 1 and FIG. 2, except that in this drawing there are three (3) conductor support floor heights creating a highest plenum portion, and intermediate height plenum portion, and a lowest height plenum portion.

FIG. 3 illustrates a two-level multilevel raised floor electro-mechanical distribution system 101 supported on the building slab 100. In this configuration the system's conditioned air plenum 105 has three height variations, namely a higher plenum portion 112 a lower height plenum portion 114, both of which are illustrated and discussed in FIG. 1 and FIG. 2, and an intermediate height plenum portion 113. The variations in plenum height are created by the varied heights of the conductor support floor 103 comprising in this configuration a higher conductor support floor section 104 a lower conductor support floor section 106 and an intermediate height conductor support floor section 107. The intermediate conductor support floor section 107 is disposed between the higher conductor support floor section and the lower conductor support floor section such that there is a conductor support floor height transition at each end of the intermediate height section. This creates the three plenum height portions, 112, 113, and 114 identified above and necessitates the positioning and installation of a plenum transition barrier 108 at each of the two conductor support floor height transitions as shown. Conditioned air 116 is shown flowing through the plenum 105, into and through vertical air passages 118 extending through the wire way level 110, and being confined to the plenum by lower conductor support floor section 106.

Figure 4:
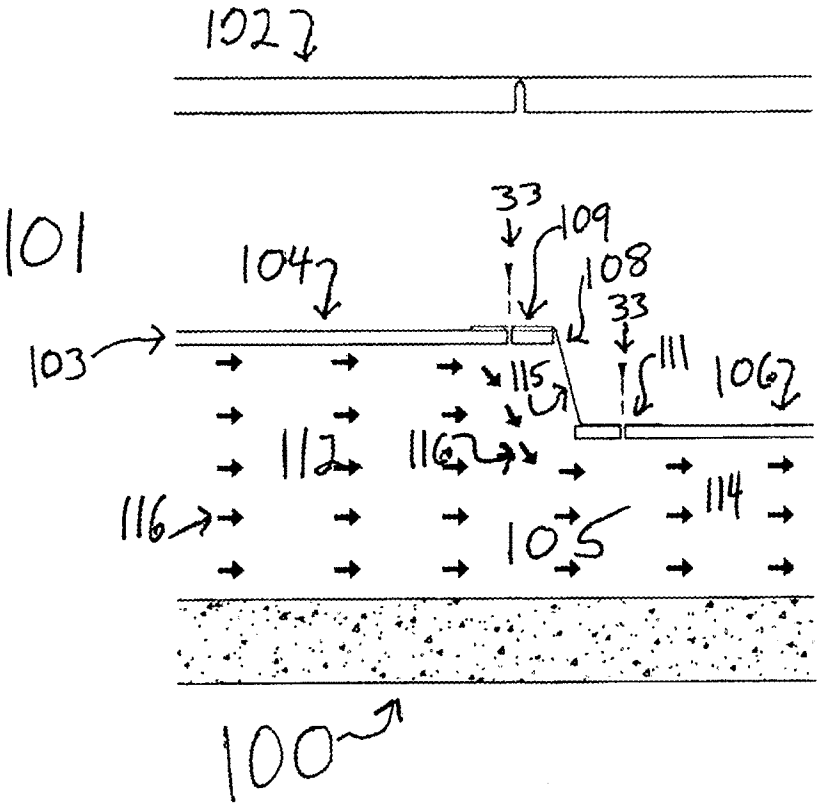
FIG. 4 is a side view detail showing a version of a plenum transition barrier adapted to be mechanically attached to portions of a higher conductor support floor section and a lower conductor support floor section.

FIG. 4 is another cut-away side view of a portion of a two-level multilevel raised floor electro-mechanical distribution system 101 showing a detail of a version of a plenum transition barrier generally designated 108 in position for attachment to higher plenum conductor support floor section 104 on its one end and to lower conductor support floor section 106 on its other end. In this particular version the plenum barrier comprises two outwardly, horizontally positioned flanges, 109 and 111, that extend in opposite directions from one another and which are substantially perpendicular to a portion 115 that extends between and connects them. Flange 109 and flange 111 are adapted to be received on the respective higher conductor support floor section and lower conductor support floor section and to be attached thereto using mechanical fasteners 33. Conditioned air 116 flowing in the conditioned air plenum 105 formed by the upper surface of building slab 100 and the under surface of conductor support floor 103 is confined to the plenum at the height transition between higher conductor support floor section 104 and lower conductor support floor section 106 by plenum transition barrier 108 when installed as described. Conditioned air is thus prohibited from entering wire way level 110, which comprises the volume between the upper surface conductor support floor 103 and the underside of walking surface 102, and electrical conductors 120 housed in the wire way level 110 cannot enter the conditioned air plenum 105.

Figure 5:
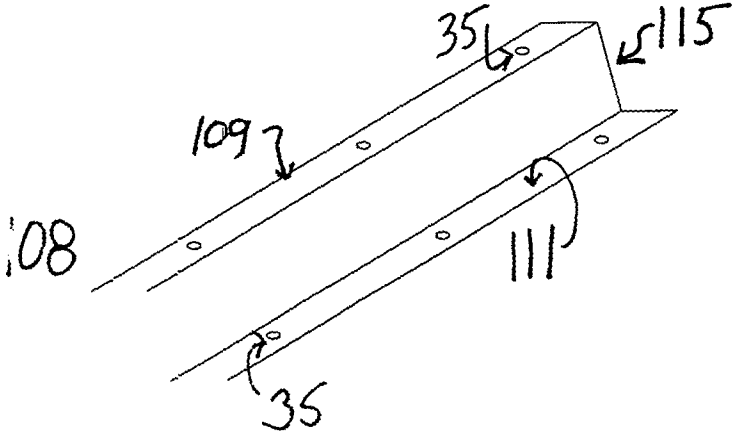
FIG. 5 is an isometric view showing a version of a plenum transition barrier adapted to be received by and attached to a higher conductor support floor section and a lower conductor support floor section.

FIG. 5 is an isometric view of a portion of a particular version of a plenum transition barrier generally designated 108 as shown and discussed in connection with FIG. 4 and other Figures. The FIG. 5 the barrier's two flanges, 109 and 111 are provided with preinstalled holes 35 to facilitate the use of mechanical fasteners for the mechanical attachment of the plenum transition barrier 108 to portions of a higher conductor support floor section 104 and a portion of a lower conductor support floor section 106, respectively.

What has been described and illustrated herein is a preferred embodiment of the invention along with some of its variations. The terms, descriptions, and figures used are set forth for purposes of illustration only and are not meant as limitations. Those skilled in the art will recognize that many variations are possible within the spirit and scope of the invention, which is intended to be defined by the by the following claims and their equivalents, in which all terms are meant in their broadest reasonable sense unless otherwise indicated. Any headings utilized within the description are for convenience only and have no legal or limiting effect.

I claim:

1. A method for improving the ventilation effectiveness of a raised floor electromechanical distribution system that has a walking surface and a conditioned air distribution plenum below the walking surface, at least a part of the conditioned air distribution plenum being defined beneath a conductor support floor disposed below the walking surface, said method comprising:

providing at least one plenum height variation in the part of the conditioned air distribution plenum defined beneath the conductor support floor such that there is at least a higher height plenum portion and a lower height plenum portion, a height of the higher and lower height plenum portions measured from a lower surface common to both the higher and lower height plenum portions and the conductor support floor;

said higher height plenum portion and said lower height plenum portion being in fluid communication with one another; and wherein when the raised floor electromechanical distribution system is in use, the higher height plenum portion receives conditioned air into the higher height plenum portion and conveys the conditioned air along the common lower surface and beneath the conductor support floor to the lower height plenum portion.

2. The method of claim 1, including providing a second plenum height variation in the conditioned air distribution plenum at a point downstream of the at least one plenum height variation and thereby creating a third plenum portion in communication with and downstream of the lower height plenum portion, the height of the third plenum portion being lower than the height of both the lower height plenum portion and the higher height plenum portion.

3. The method of claim 1, including positioning the higher height plenum portion nearer a source of conditioned air than the lower height plenum portion.

4. The method of claim 1, including defining the higher height plenum portion and the lower height plenum portion at least in part by an under surface of the conductor support floor below a wire way level that is disposed in between the conductor support floor and the walking surface.

5. The method of claim 4, including disposing an air barrier along a border between the higher height plenum portion and the lower height plenum portion, the barrier extending vertically along the border between vertically spaced-apart ends of the conductor support floor and fluidly separating the conditioned air distribution plenum from the wire way level.

6. The method of claim 5, including making said air barrier from modular barrier sections.

7. The method of claim 1, wherein the step of providing the third plenum portion includes defining the third plenum portion at least in part by an under surface of the conductor support floor below a wire way level that is disposed in between the conductor support floor and the walking surface.

8. The method of claim 1, including the step of distributing the conditioned air from at least the lower height plenum portion into a space above the walking surface via at least one air conduit that extends from the lower height plenum portion to the walking surface through a wire way level disposed between the conductor support floor and the walking surface.

9. The method of claim 4, comprising fluidly connecting at least one of the lower height plenum portion and the higher height plenum portion to a space above the walking surface via at least one air conduit, the step of fluidly connecting including extending the at least one air conduit through the wire way level, and creating an air barrier between the wire way level and the conditioned air distribution plenum.

10. The method of claim 1, comprising defining at least one of the lower height plenum portion and the higher height plenum portion by a building slab disposed below the conductor support floor, the building slab defining the common lower surface.

11. A method for ventilating a multilevel raised floor air distribution system having an air distribution plenum receiving conditioned air from a source of conditioned air, and at least one conduit conveying, when the air distribution system is in use, the conditioned air from the air distribution plenum into a space that has a walking surface, at least in part through the walking surface, the method comprising:

providing at least a part of the air distribution plenum below a conductor support floor that is disposed below the walking surface; and providing, in the air distribution plenum, a higher height plenum portion below the conductor support floor and a lower height plenum portion below the conductor support floor, a height of the higher and lower height plenum portions measured from a lower surface common to both the higher and lower height plenum portions and the conductor support floor, the lower height plenum portion being in fluid communication with the higher height plenum portion; and configuring the higher height plenum portion to receive the conditioned air and convey the received conditioned air along the common lower surface and beneath the conductor support floor into the lower height plenum portion when the air distribution system is in use.

12. The method of claim 11, comprising fluidly separating the higher height plenum portion and the lower height plenum portion from a volume disposed between the conductor support floor and the walking surface.

13. The method of claim 12, wherein the fluidly separating includes providing an air barrier along a border between the higher height plenum portion and the lower height plenum portion, the air barrier extending vertically along the border between vertically spaced-apart ends of the conductor support floor.

14. The method of claim 11, comprising fluidly connecting at least one of the higher height plenum portion and the lower height plenum portion to the space via the at least one conduit fluidly connected to the space via the walking surface.

15. The method of claim 11, wherein:

the higher height plenum portion is a first higher height plenum portion disposed on a first side of the lower height plenum portion; and the method further includes providing a second higher height plenum portion in the part of the air distribution plenum below the conductor support floor on another side of the lower height plenum portion and in fluid communication with the lower height plenum portion, each of the first and second higher height plenum portions having a larger height than the height of the lower height plenum portion, the first and second higher height plenum portions receiving the conditioned air from the source of the conditioned air and conveying the conditioned air to the lower height plenum portion when the air distribution system is in use.

16. The method of claim 11, comprising making the lower height plenum portion smaller in volume than the higher height plenum portion.

17. A raised floor air distribution system, comprising:

a walking surface defining a space above the walking surface;

a conductor support floor disposed below the walking surface and defining a wire way level disposed under the walking surface and above the conductor support floor;

an air distribution plenum defined at least in part by the conductor support floor below the conductor support floor, the conductor support floor defining:

a first height plenum portion of the air distribution plenum, the first height plenum portion receiving conditioned air into the first height plenum portion when the raised floor air distribution system is in use; and a second height plenum portion of the air distribution plenum, the second height plenum portion being in fluid communication with the first height plenum portion and receiving the conditioned air from the first height plenum portion when the raised floor air distribution system is in use, the second height plenum portion having a height lower than a height of the first height plenum portion, the height of the first and second height plenum portions measured from a lower surface common to both the first and second height plenum portions and the conductor support floor; and an air conduit fluidly connecting the second height plenum portion to the space above the walking surface.

18. The raised floor air distribution system of claim 17, wherein the air conduit is a second air conduit and further comprising a first air conduit fluidly connecting the first height plenum portion to the space above the walking surface, and wherein at least one of the first and second air conduits passes through the wire way level.

19. The raised floor air distribution system of claim 18, comprising an air barrier fluidly separating the air distribution plenum from the wire way level, the air barrier extending vertically between vertically spaced-apart ends of the conductor support floor.

20. The raised floor air distribution system of claim 18, wherein the first and second height plenum portions are defined by an under surface of the conductor support floor and the wire way level is disposed above the first and second height plenum portions.

* * * * *